US012286972B2

(12) United States Patent
Dong et al.

(10) Patent No.: US 12,286,972 B2
(45) Date of Patent: Apr. 29, 2025

(54) PUMP BODY ASSEMBLY, FLUID MACHINERY, AND HEAT EXCHANGE DEVICE

(71) Applicant: GREE ELECTRIC APPLIANCES, INC. OF ZHUHAI, Guangdong (CN)

(72) Inventors: Mingzhu Dong, Zhuhai (CN); Yusheng Hu, Zhuhai (CN); Jia Xu, Zhuhai (CN); Zhongcheng Du, Zhuhai (CN); Liping Ren, Zhuhai (CN); Lingchao Kong, Zhuhai (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 719 days.

(21) Appl. No.: 17/059,146

(22) PCT Filed: Dec. 12, 2018

(86) PCT No.: PCT/CN2018/120659
§ 371 (c)(1),
(2) Date: Nov. 25, 2020

(87) PCT Pub. No.: WO2020/015284
PCT Pub. Date: Jan. 23, 2020

(65) Prior Publication Data

US 2021/0372408 A1 Dec. 2, 2021

(30) Foreign Application Priority Data

Jul. 18, 2018 (CN) ..... 201810792233.8

(51) Int. Cl.
*F04C 29/12* (2006.01)
*F04C 18/22* (2006.01)
*F04C 29/00* (2006.01)

(52) U.S. Cl.
CPC ..... *F04C 29/12* (2013.01); *F04C 18/22* (2013.01); *F04C 29/0057* (2013.01);
(Continued)

(58) Field of Classification Search
None
See application file for complete search history.

(56) References Cited

U.S. PATENT DOCUMENTS 1,802,887 A * 4/1931 Feyens ..... F01C 1/22 418/117
2,117,448 A * 5/1938 Pontis ..... F04B 27/0663 417/462

(Continued)

FOREIGN PATENT DOCUMENTS

CN 105570128 A * 5/2016 ..... F01C 21/0809
CN 105570130 A 5/2016

(Continued)

OTHER PUBLICATIONS

Machine translation of CN-107165822 (Obtained from USPTO Search Copyright 2023 Clarivate Analytics) (Year: 2023).*

(Continued)

*Primary Examiner* — Bryan M Lettman
*Assistant Examiner* — Geoffrey S Lee
(74) *Attorney, Agent, or Firm* — J. Miguel Hernandez; James R. Gourley; Carstens, Allen & Gourley, LLP

(57) ABSTRACT

Pump body assembly, fluid machinery, and a heat exchange device. The pump body assembly includes: an upper flange; a lower flange; a cylinder arranged between the upper flange and the lower flange; a sliding block structure, rotatably arranged inside the cylinder, where the sliding block structure includes a connecting portion and two sliding sub-blocks arranged on the connecting portion, and the two sliding sub-blocks and an inner wall surface of the cylinder (Continued)

form a first sliding hole; a piston, slidably arranged inside the first sliding hole, where a variable volume cavity is formed between the piston and an inner wall of the cylinder, and the piston has a second sliding hole; and a rotation shaft, where at least a portion of the rotation shaft is slidably arranged inside the second sliding hole.

13 Claims, 10 Drawing Sheets

(52) U.S. Cl.
CPC ..... *F04C 2240/10* (2013.01); *F04C 2240/20* (2013.01); *F04C 2240/60* (2013.01); *F04C 2240/805* (2013.01)

(56) References Cited

U.S. PATENT DOCUMENTS

| | | | | | |
|---|---|---|---|---|---|
| 2,411,929 | A | * | 12/1946 | Malke | F04B 27/0465 417/462 |
| 3,279,445 | A | * | 10/1966 | Karol | F01B 13/02 91/197 |
| 4,137,019 | A | * | 1/1979 | Hofmann | F04B 39/0246 417/462 |
| 10,626,858 | B2 | * | 4/2020 | Du | F04C 18/34 |
| 10,941,771 | B2 | * | 3/2021 | Hu | F04C 18/34 |
| 2018/0230981 | A1 | * | 8/2018 | Du | F04B 29/00 |
| 2018/0245591 | A1 | * | 8/2018 | Hu | F04C 29/02 |
| 2021/0340980 | A1 | * | 11/2021 | Xu | F01C 21/08 |
| 2021/0348610 | A1 | * | 11/2021 | Hu | F04C 18/344 |
| 2021/0372408 | A1 | * | 12/2021 | Dong | F04C 29/0057 |
| 2023/0160376 | A1 | * | 5/2023 | Hu | F04C 18/3441 92/153 |

FOREIGN PATENT DOCUMENTS

| | | | | | |
|---|---|---|---|---|---|
| CN | 205401107 | U | | 7/2016 | |
| CN | 105840509 | A | * | 8/2016 | |
| CN | 106640645 | A | * | 5/2017 | F01B 13/02 |
| CN | 107152392 | A | | 9/2017 | |
| CN | 107165822 | A | * | 9/2017 | F04C 18/3562 |
| CN | 107435634 | A | | 12/2017 | |
| CN | 107559194 | A | | 1/2018 | |
| CN | 108799104 | A | * | 11/2018 | F01C 1/344 |
| CN | 108799105 | A | * | 11/2018 | F04C 18/00 |
| CN | 108799106 | A | * | 11/2018 | F04C 18/00 |
| CN | 108916045 | A | | 11/2018 | |
| EP | 1479914 | A1 | | 11/2004 | |
| JP | 4547978 | B2 | | 9/2010 | |
| WO | 2017024864 | A1 | | 2/2017 | |

OTHER PUBLICATIONS

Machine translation of CN-108799106 (Obtained from USPTO Search Copyright 2023 Clarivate Analytics) (Year: 2023).*
Machine translation of CN-105570128 (Obtained from USPTO Search Copyright 2023 Clarivate Analytics) (Year: 2023).*
Machine translation of CN-105840509 (Obtained from USPTO Search Copyright 2023 Clarivate Analytics) (Year: 2023).*
Machine translation of CN-108799105 (Obtained from USPTO Search Copyright 2023 Clarivate Analytics) (Year: 2023).*
Machine translation of CN-106640645 (Obtained from USPTO Search Copyright 2023 Clarivate Analytics) (Year: 2023).*
Machine translation of CN-108799104 (Obtained from USPTO Search Copyright 2023 Clarivate Analytics) (Year: 2023).*
Extended European Search Report for European Application No. 18927033.3 dated Dec. 7, 2020 (7 pages).
International Search Report for Application No. PCT/CN2018/120659 dated Feb. 11, 2019 (3 pages).

* cited by examiner

PUMP BODY ASSEMBLY, FLUID MACHINERY, AND HEAT EXCHANGE DEVICE

CROSS REFERENCE TO RELATED APPLICATIONS

This application claims all benefits accruing under 35 U.S.C. § 119 from China Patent Application No. 201810792233.8, filed on Jul. 18, 2018 in the China National Intellectual Property Administration, the entire content of which is hereby incorporated by reference. This application is a national phase under 35 U.S.C. § 120 of international patent application PCT/CN2018/120659, entitled "PUMP BODY ASSEMBLY, FLUID MACHINERY, AND HEAT EXCHANGE DEVICE" filed on Dec. 12, 2018 and published as WO 2020/015284 on Jan. 23, 2020, the content of which is also hereby incorporated by reference. Every patent application and publication listed in this paragraph is hereby incorporated by reference in its entirety.

TECHNICAL FIELD

The present disclosure relates to the field of pump body technologies, and specifically, to a pump body assembly, fluid machinery, and a heat exchange device.

BACKGROUND

In the related technology, outer surfaces of two sliding blocks are separately in direct contact with an inner surface of a cylinder, and a friction pair is formed at the contact position. During a high-speed operation of a pump body assembly, the two sliding blocks are separately under the action of a centrifugal force. Consequently, the two sliding blocks and an inner wall of the cylinder are stuck tightly together, increasing the contact area therebetween and further increasing a friction force between the sliding blocks and the cylinder, leading to relatively high friction loss of the cylinder of the pump body assembly. Research results indicate that friction power consumption at the contact position between the sliding blocks and the cylinder reaches over 80% of overall mechanical power consumption.

SUMMARY

The present disclosure provides a pump body assembly, fluid machinery, and a heat exchange device, to solve the problem of relatively high friction loss of a cylinder during the operation of the pump body assembly in the related technology.

According to an aspect of the present disclosure, a pump body assembly is provided, and includes an upper flange; a lower flange; a cylinder, arranged between the upper flange and the lower flange; a sliding block structure, rotatably arranged inside the cylinder, the sliding block structure includes a connecting portion and two sliding sub-blocks arranged on the connecting portion, and the two sliding sub-blocks and an inner wall surface of the cylinder form a first sliding hole; a piston, slidably arranged inside the first sliding hole, where a variable volume cavity is formed between the piston and an inner wall of the cylinder, and the piston has a second sliding hole; and a rotation shaft, where at least a portion of the rotation shaft is slidably arranged inside the second sliding hole, and a slide included angle is formed between a first sliding direction, in which the piston slides relative to the first sliding hole, and a second sliding direction, in which the rotation shaft slides relative to the second sliding hole.

Further, there is at least one connecting portion; the at least one connecting portion is provided with a first through hole; and the rotation shaft passes through the first through hole.

Further the sliding block structure is connected to the lower flange and/or the upper flange by means of pivot.

Further a first connecting portion is arranged on the connecting portion; a second connecting portion is arranged on the lower flange; and the first connecting portion and the second connecting portion are nested and fit to connect the sliding block structure with the lower flange.

Further the first connecting portion is the first through hole; the second connecting portion is a position-limiting protrusion; the position-limiting protrusion extends into the first through hole to enable the sliding block structure to pivot relative to the lower flange; the position-limiting protrusion has a second through hole; and the rotation shaft passes through the second through hole.

Further the position-limiting protrusion is a round protruding platform arranged coaxially with the lower flange; the second through hole and the round protruding platform are eccentrically arranged, and an eccentricity e is fixed; and the cylinder and the lower flange are arranged coaxially.

Further an inner cavity of the cylinder is in a shape of a circular hole; opposite surfaces of the two sliding sub-blocks are surfaces on which the piston slides, and are parallel to each other; and surfaces of the two sliding sub-blocks, which face the inner cavity, fit the shape of the inner cavity.

Further the sliding block structure is manufactured and processed through cutting.

Further an exhaust hole is disposed in a side wall of the cylinder, and the ump body assembly further includes an exhaust valve assembly, wherein the exhaust valve assembly is arranged on an outer surface of the cylinder and is arranged corresponding to the exhaust hole.

In some embodiments, the variable volume cavity comprises two cavities, and each cavity is formed by an arc surface of the piston and the inner wall of the cylinder.

In some embodiments, an eccentricity between a centerline $O_1$ of the sliding block structure 40 and a centerline $O_2$ of the rotation shaft is e, and the sliding block structure and the rotation shaft rotate around their respective centerlines.

In some embodiments, there is one connecting portion, and the connecting portion is disposed at ends of the two sliding sub-blocks, which are proximate to the lower flange, to connect the two sliding sub-blocks together.

In some embodiments, there are two connecting portions, and the two connecting portions are respectively arranged at two ends of the sliding sub-block.

In some embodiments, the sliding block structure is symmetrical.

In some embodiments, the rotation shaft comprises a cylindrical section and a sliding section connected sequentially along a length direction of the rotation shaft; the cylindrical section is connected to an upper flange by means of pivot; the sliding section has two rotation shaft sliding surfaces arranged opposite to each other; and the two rotation shaft sliding surfaces slidably fit a groove wall of the second sliding hole.

In some embodiments, a lubrication groove is provided on each rotation shaft sliding surface, and the lubrication groove is connected to a center hole of the rotation shaft through an oil passage hole.

In some embodiments, the cylinder has a suction passage extending along a radial direction of the cylinder, and an outlet of the suction passage is arc-shaped.

According to another aspect of the present disclosure, fluid machinery is provided, and includes the foregoing pump body assembly.

According to another aspect of the present disclosure, a heat exchange device is provided, and includes the foregoing fluid machinery.

In the technical solutions of the present disclosure, during the operation of the pump body assembly, at least a portion of the rotation shaft fits the second sliding hole of the piston and drives the piston to move, so that the piston performs a reciprocating motion along the first sliding direction relative to the rotation shaft. When the piston moves relative to the rotation shaft, the piston slides inside the first sliding hole simultaneously, and the sliding block structure is driven by the piston to move, so that the piston performs a reciprocating motion along the second sliding direction relative to the sliding block structure. The slide included angle is formed between the first sliding direction and the second sliding direction, and the piston performs a superposition movement along the first sliding direction and the second sliding direction, so the volume distribution of the variable volume cavity can be changed during the movement of the piston, thereby implementing intake, compression, and exhausting operations of the pump body assembly, and ensuring the normal operation of the pump body assembly.

In this case, the sliding block structure is an integral structure, and the two sliding sub-blocks are both arranged on the connecting portion. Compared with arrangement of two separated sliding blocks in the related technology, the foregoing structure arrangement of the sliding block structure in this application avoids the relatively high friction loss between the sliding block structure and the cylinder caused by the centrifugal forces, thereby reducing the friction loss of the cylinder, prolonging the service life of the pump body assembly, and improving the working efficiency of the pump body assembly.

BRIEF DESCRIPTION OF THE DRAWINGS

The accompanying drawings attached to the specification form a part of the present application and are intended to provide a further understanding of the present disclosure. The illustrative embodiments of the present disclosure and the description thereof are used for explanations of the present disclosure, and do not constitute improper limitations of the present disclosure. In the accompanying drawings.

DETAILED DESCRIPTION OF THE EMBODIMENTS

Figure 1:
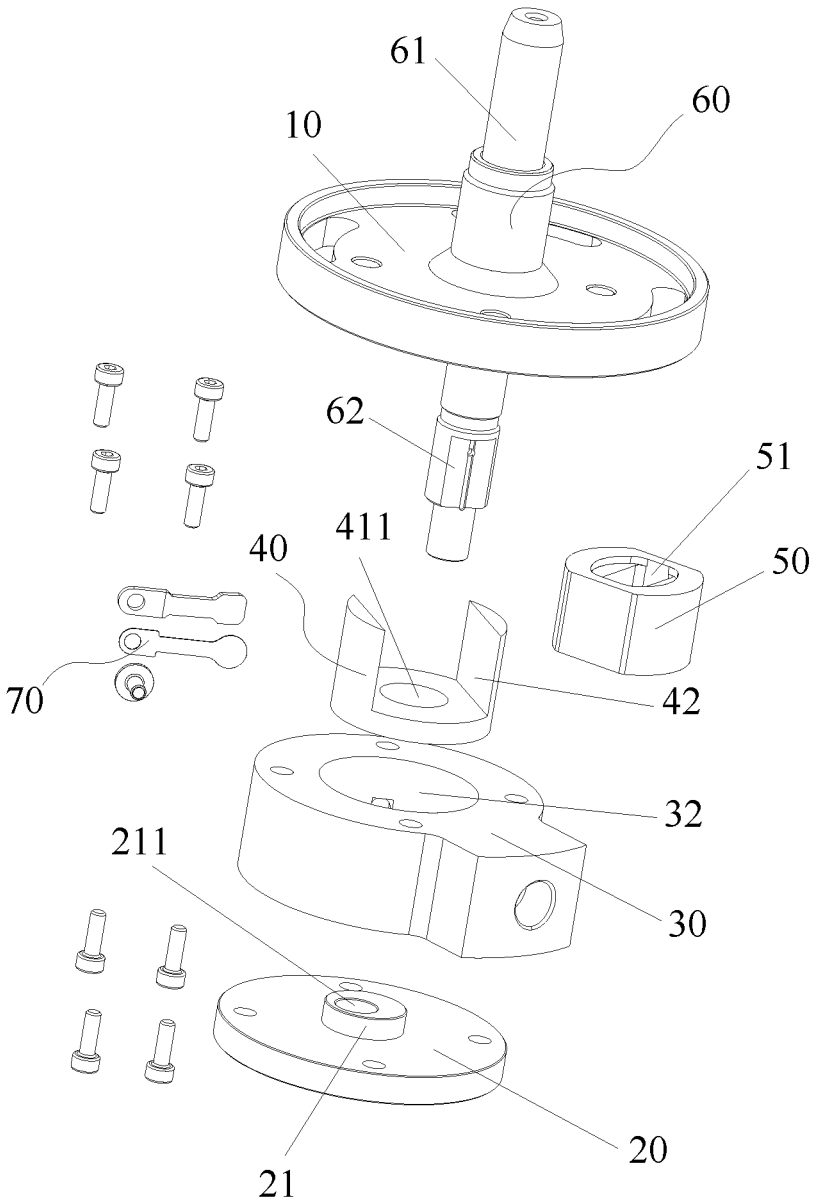
FIG. 1 shows a schematic exploded structural diagram of a pump body assembly according to some embodiments of the present disclosure.

It should be noted that the embodiments in the present application and the features in the embodiments can be combined with each other if no conflicts occur. The present disclosure will be described in detail below with reference to the accompanying drawings in combination with the embodiments.

It should be noted that, unless otherwise indicated, all technical and scientific terms used herein have the same meanings as commonly understood by the ordinary skilled in the art of the present application.

In the present disclosure, unless stated to the contrary, the orientation words such as "up, down" are usually used to refer to the orientations shown in the drawings, or to the component itself in the vertical, orthographic or gravity direction. Similarly, in order to facilitate the understanding and the description, "left, right" are usually used to refer to the left and right shown in the drawings, and "inner" and "outer" refer to "inner" and "outer" relative to the outline of each component itself. However, the orientation words are not given to limit the present application.

To solve the problem of relatively high friction loss of a cylinder during the operation of a pump body assembly in the related technology, a pump body assembly, fluid machinery, and a heat exchange device are provided in this application.

Figure 2:
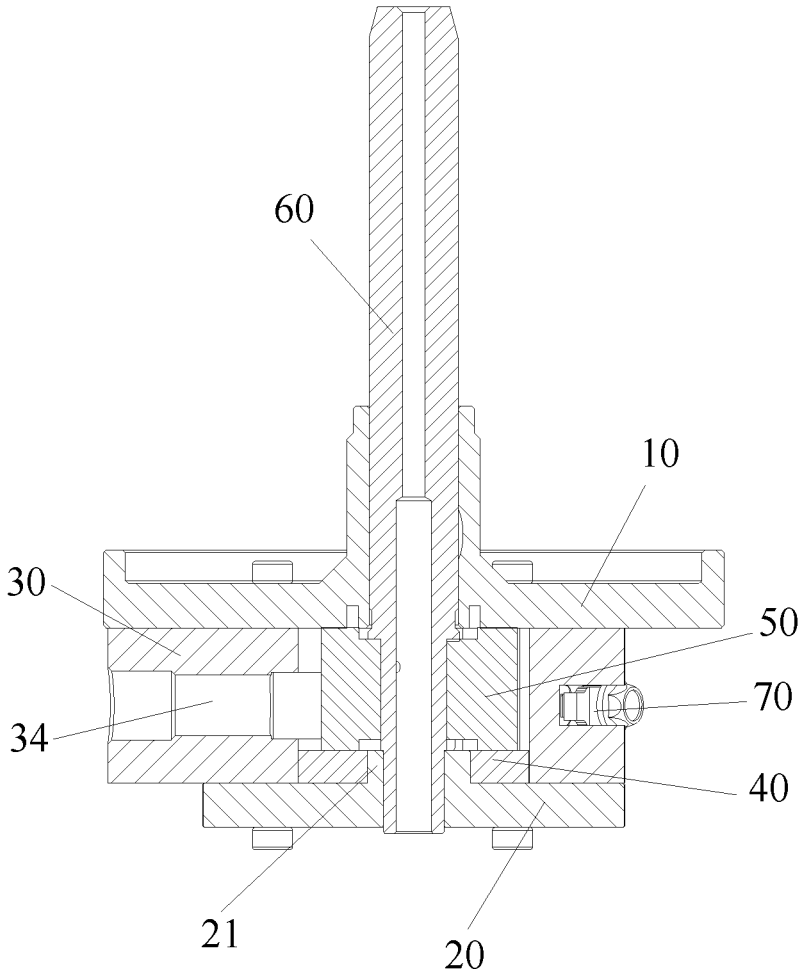
FIG. 2 shows a longitudinal cross-sectional view of the pump body assembly in FIG. 1.
Figure 3:
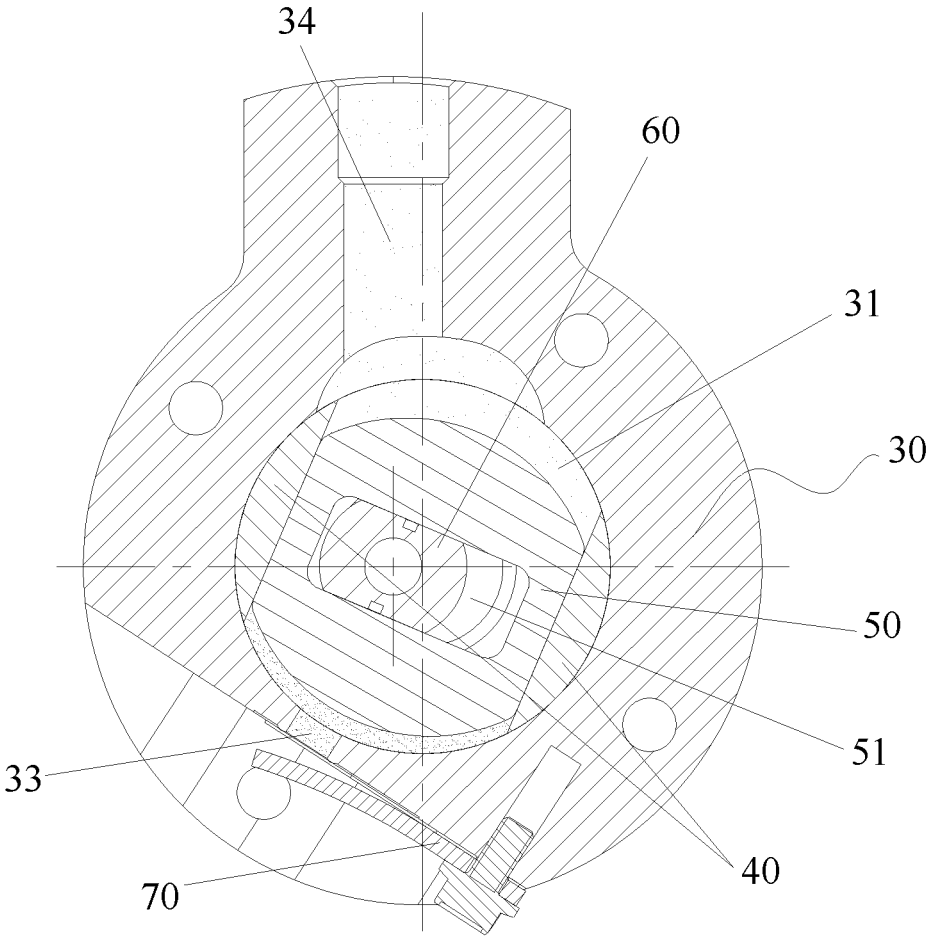
FIG. 3 shows a transverse cross-sectional view of the pump body assembly in FIG. 1.

As shown in FIG. 1 to FIG. 3, the pump body assembly includes an upper flange 10, a lower flange 20, a cylinder 30, a sliding block structure 40, a piston 50, and a rotation shaft 60. The cylinder 30 is arranged between the upper flange 10 and the lower flange 20. The sliding block structure 40 is rotatably arranged inside the cylinder 30. The sliding block structure 40 includes a connecting portion 41 and two sliding sub-blocks 42 arranged on the connecting portion 41, and the two sliding sub-blocks 42 and an inner wall surface of the cylinder 30 form a first sliding hole 31. The piston 50 is slidably arranged inside the first sliding hole 31. A variable volume cavity is formed between the piston 50 and an inner wall of the cylinder 30, and the piston 50 has a second sliding hole 51. At least a portion of the rotation shaft 60 is slidably arranged inside the second sliding hole 51, and a slide included angle is formed between a first sliding direction, in which the piston 50 slides relative to the first sliding hole 31, and a second sliding direction, in which the rotation shaft 60 slides relative to the second sliding hole 51.

During the operation of the pump body assembly, at least a portion of the rotation shaft 60 fits the second sliding hole 51 of the piston 50 and drives the piston 50 to move, so that the piston 50 performs a reciprocating motion along the first sliding direction relative to the rotation shaft 60. When the piston 50 moves relative to the rotation shaft 60, the piston 50 slides inside the first sliding hole 31, and the sliding block structure 40 is driven by the piston 50 to move, so that the piston 50 performs a reciprocating motion along the second sliding direction relative to the sliding block structure 40. Because the slide included angle is formed between the first sliding direction and the second sliding direction, and the piston 50 performs a superposition motion of the first sliding direction and the second sliding direction, a volume distribution of the variable volume cavity can be changed during the motion of the piston 50, thereby implementing intake, compression, and exhausting operations of the pump body assembly, and ensuring normal operation of the pump body assembly.

In this case, the sliding block structure 40 is an integral structure, and the two sliding sub-blocks 42 are both arranged on the connecting portion 41. Compared with arrangement of two separated sliding blocks in the related technology, the foregoing structure arrangement of the sliding block structure 40 in these embodiments can avoid relatively high friction loss between the sliding block structure 40 and the cylinder 30 caused by a centrifugal force, and the friction loss of the cylinder 30 is therefore reduced, thereby prolonging the service life of the pump body assembly, and improving the working efficiency of the pump body assembly.

In these embodiments, the two separated sliding sub-blocks 42 are connected together via the connecting portion 41, so that centrifugal forces of the two sliding sub-blocks 42 counteract each other during the operation of the pump body assembly, and a force exerted between the sliding block structure 40 and the inner wall of the cylinder 30 is reduced, thereby reducing friction power consumption between the sliding block structure 40 and the cylinder 30.

In these embodiments, the variable volume cavity includes two cavities. In the process while the piston 50 moves relative to the cylinder 30, volumes of the two cavities constantly change, thereby implementing intake, compression, and exhausting operations of the pump body assembly, and ensuring normal operation of the pump body assembly. Specifically, each cavity is formed by an arc surface of the piston 50 and the inner wall of the cylinder 30.

As shown in FIG. 3, the first sliding direction is perpendicular to the second sliding direction. Specifically, because a cross sliding block type mechanism is formed among the piston 50, the rotation shaft 60, and the sliding block structure 40, the piston 50 moves inside the cylinder 30 stably and continuously, and a regular volume change of the variable volume cavity is ensured, thereby ensuring the operation stability of the pump body assembly, and further improving the working reliability of the pump body assembly.

The operation of the pump body assembly is described in detail below.

Figure 12:
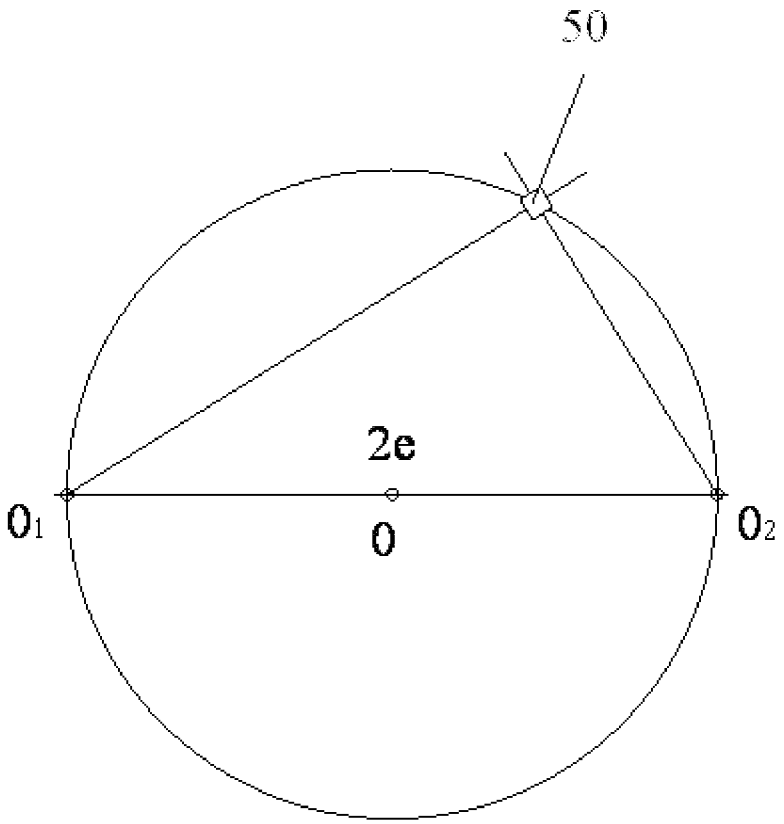
FIG. 12 shows a diagram of an operating principle of the pump body assembly in FIG. 1.

As shown in FIG. 12, the pump body assembly is arranged according to a principle of a cross sliding block type mechanism. The piston 50 serves as a sliding block in the cross sliding block type mechanism. A distance between a centerline $O_1$ of the sliding block structure 40 and a center of the piston 50, and a distance between a centerline $O_2$ of the rotation shaft 60 and the center of the piston 50 are respectively equivalent to two connecting rods $l_1$ and $l_2$. In this way, a main body structure in the principle of the cross sliding block type mechanism is formed. An eccentricity between the centerline $O_1$ of the sliding block structure 40 and the centerline $O_2$ of the rotation shaft 60 is e, and the sliding block structure 40 and the rotation shaft 60 rotate around their respective centerlines. When the rotation shaft 60 rotates, the piston 50 performs a linear reciprocating slide relative to the rotation shaft 60. At the same time, the piston 50 drives the sliding block structure 40 to rotate, and performs a linear reciprocating slide relative to the sliding block structure 40, to implement actions of intake, compression, and exhausting of the pump body assembly. The piston 50 runs relative to the centerline of the sliding block structure 40 within a range of the eccentricity e. A journey of the piston 50 is 2e, a cross-sectional area of the piston 50 is S, and a displacement (that is, the maximum intake volume) of the pump body assembly is V=2*(2e*S).

Optionally, there is at least one connecting portion 41, and the connecting portion 41 is provided with a first through hole 411 for the rotation shaft 60 to pass through. As shown in FIG. 5 to FIG. 8, there is one connecting portion 41 in some embodiments, and the connecting portion 41 is disposed at ends of the two sliding sub-blocks 42, which are proximate to the lower flange 20, to connect the two sliding sub-blocks 42 together. The foregoing structure is simple and easy to process.

It should be noted that the quantity and position of the connecting portion 41 are not limited thereto. Optionally, there are two connecting portions 41, and the two connecting portions 41 are respectively arranged at two ends of the sliding sub-block 42.

As shown in FIG. 1 and FIG. 2, the sliding block structure 40 is connected to the lower flange 20 by means of pivot. Specifically, during the operation of the pump body assembly, at least a portion of the rotation shaft 60 fits the second sliding hole 51 of the piston 50 and drives the piston 50 to move, so that the piston 50 performs a reciprocating motion along the first sliding direction relative to the rotation shaft 60. When the piston 50 moves relative to the rotation shaft 60, the piston 50 slides inside the first sliding hole 31, and the sliding block structure 40 is driven by the piston 50 to rotate relative to the lower flange 20, so that the piston 50 performs a reciprocating motion along the second sliding direction relative to the sliding block structure 40. The volume distribution of the variable volume cavity can be changed during the movement of the piston 50, thereby realizing intake, compression, and exhausting operations of the pump body assembly, and ensuring normal operation of the pump body assembly.

In other embodiments not shown in the accompanying drawings, the sliding block structure is connected to the upper flange by means of pivot. Specifically, during the operation of the pump body assembly, at least a portion of the rotation shaft fits the second sliding hole of the piston and drives the piston to move, so that the piston performs a reciprocating motion along the first sliding direction relative to the rotation shaft. While the piston is moving relative to the rotation shaft, the piston slides inside the first sliding hole simultaneously, and the sliding block structure is driven by the piston to rotate relative to the upper flange, so that the piston performs a reciprocating motion along the second sliding direction relative to the sliding block structure. The volume distribution of the variable volume cavity can be changed during the movement of the piston, thereby realizing intake, compression, and exhausting operations of the pump body assembly, and ensuring normal operation of the pump body assembly.

In other embodiments not shown in the accompanying drawings, the sliding block structure is connected to the upper flange and the lower flange by means of pivot. Specifically, during the operation of the pump body assembly, at least a portion of the rotation shaft fits the second sliding hole of the piston and drives the piston to move, so that the piston performs a reciprocating motion along the first sliding direction relative to the rotation shaft. While the piston is moving relative to the rotation shaft, the piston slides inside the first sliding hole simultaneously, and the sliding block structure is driven by the piston to rotate relative to the upper flange and the lower flange, so that the piston performs a reciprocating motion along the second sliding direction relative to the sliding block structure. The volume distribution of the variable volume cavity can be changed during the movement of the piston, thereby realizing intake, compression, and exhausting operations of the pump body assembly, and ensuring normal operation of the pump body assembly.

In some embodiments, a first connecting portion is arranged on the connecting portion 41; a second connecting portion is arranged on the lower flange 20; and the first connecting portion and the second connecting portion are nested and fit to connect the sliding block structure 40 with the lower flange 20. Specifically, the first connecting portion and the second connecting portion are nested and fit to implement assembly of the sliding block structure 40 and the lower flange 20, so that the inner structure of the cylinder 30 is more compact, and a structural arrangement is more reasonable. The foregoing structure is simple and easy to assemble and implement.

As shown in FIG. 5 to FIG. 10, the first connecting portion is the first through hole 411, and the second connecting portion is a position-limiting protrusion 21. The position-limiting protrusion 21 extends into the first through hole 411 to enable the sliding block structure 40 to pivot relative to the lower flange 20. The position-limiting protrusion 21 has a second through hole 211. The rotation shaft 60 passes through the second through hole 211. The foregoing structure arrangement makes the structure of the sliding block structure 40 and the lower flange 20 simpler, and easy to process and assemble.

In other embodiments not shown in the accompanying drawings, the first connecting portion is the position-limiting protrusion, and the second connecting portion is the first through hole. The position-limiting protrusion extends into the first through hole to enable the sliding block structure to pivot relative to the lower flange. The position-limiting protrusion has a second through hole. The rotation shaft passes through the second through hole. The foregoing structure arrangement makes the structure of the sliding block structure and the structure of the lower flange simpler, and easy to process and assemble.

Figure 5:
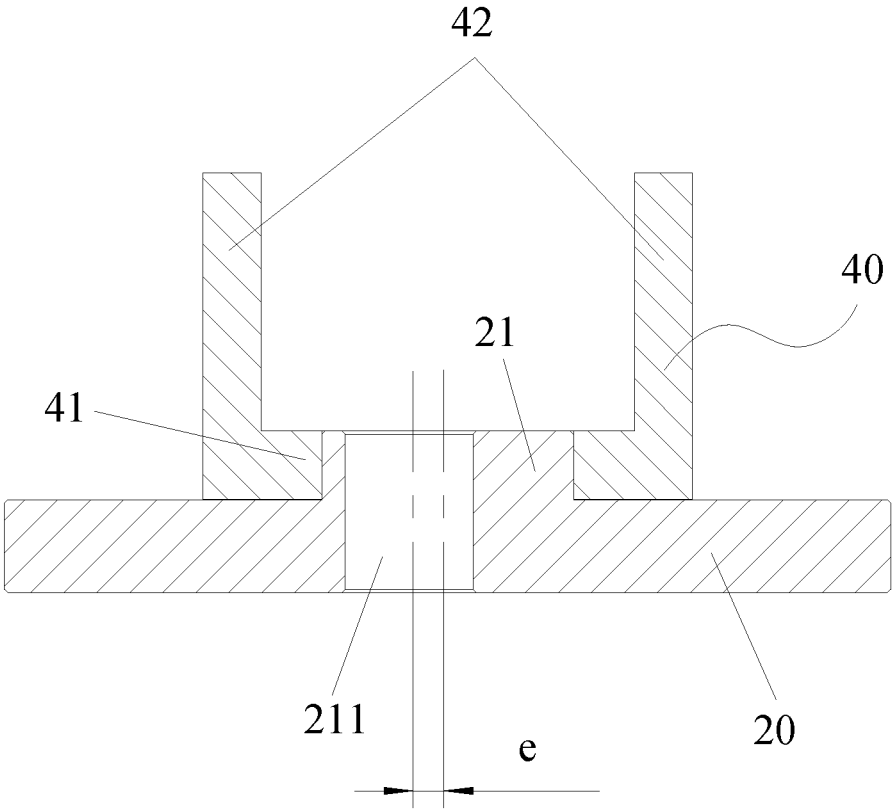
FIG. 5 shows a cross-sectional view of assembly of a lower flange and a sliding block structure of the pump body assembly in FIG. 1.
Figure 6:
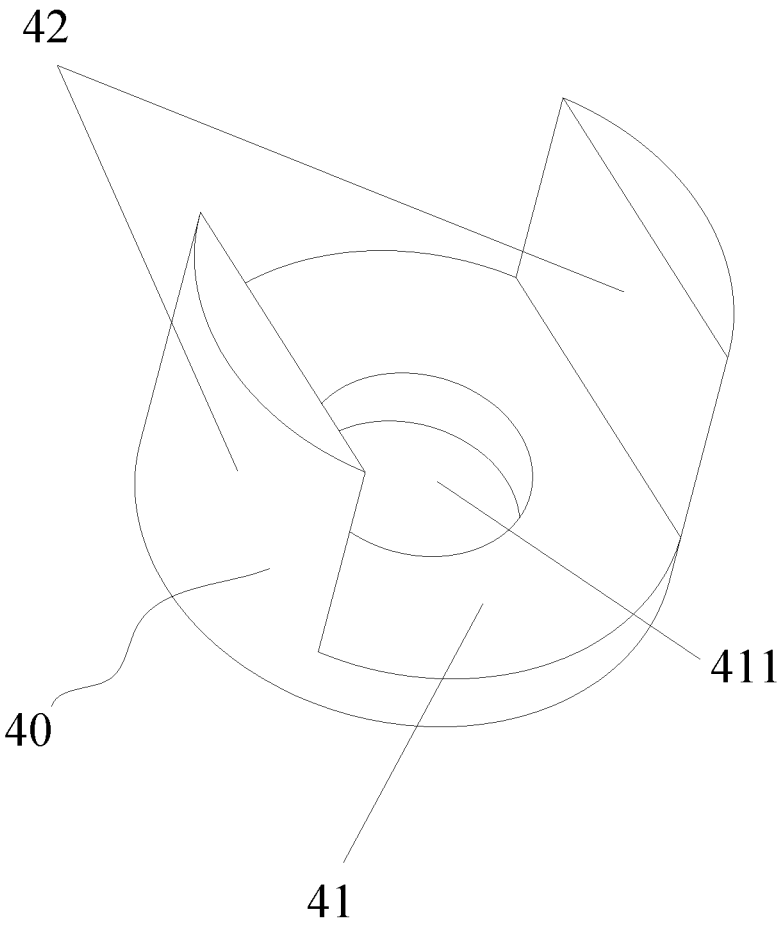
FIG. 6 shows a schematic three-dimensional structure diagram of the sliding block structure in FIG. 5.
Figure 7:
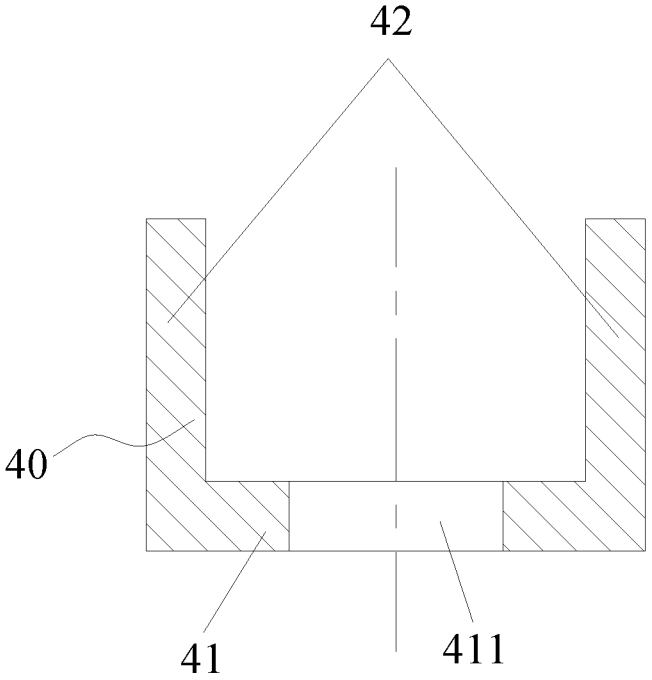
FIG. 7 shows a cross-sectional view of the sliding block structure in FIG. 6.
Figure 8:
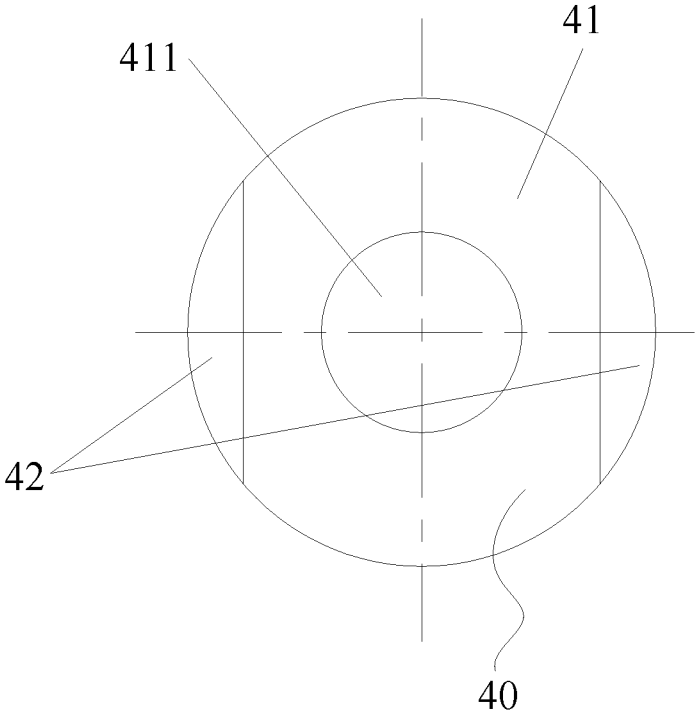
FIG. 8 shows a top view of the sliding block structure in FIG. 6.
Figure 9:
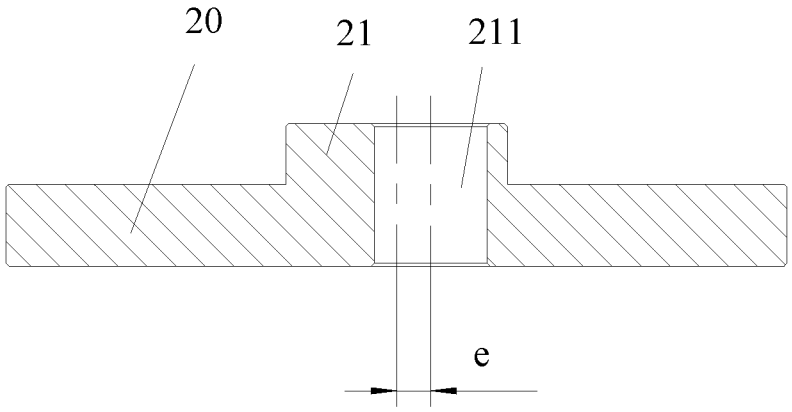
FIG. 9 shows a cross-sectional view of the lower flange in FIG. 5.
Figure 10:
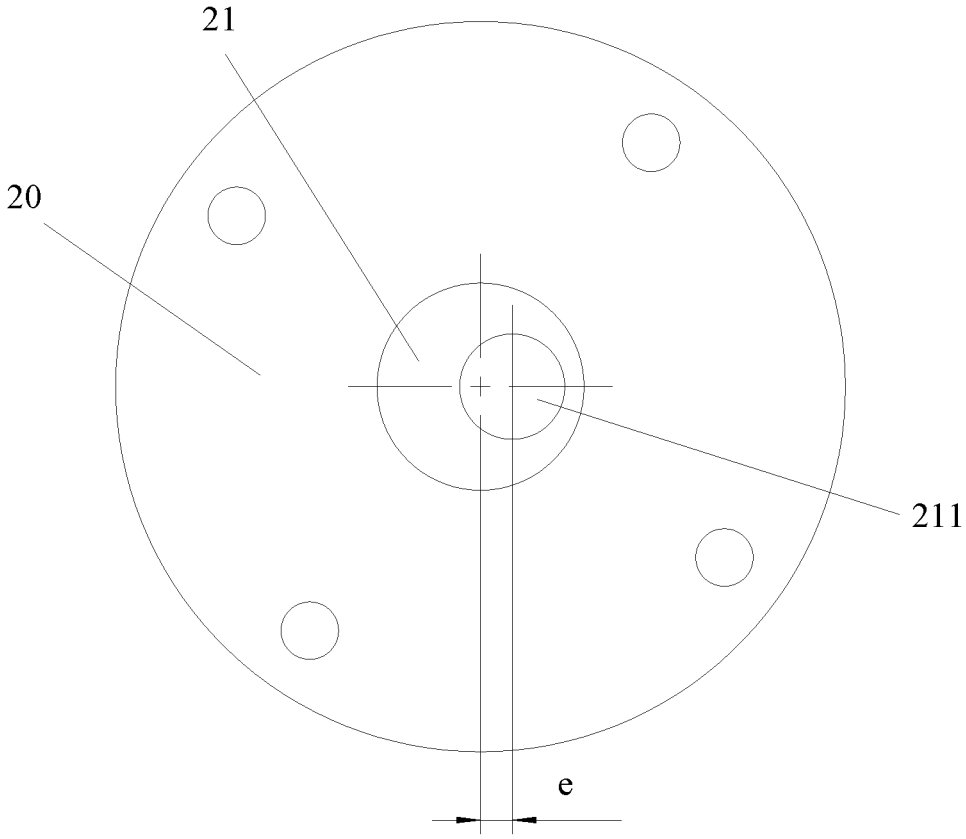
FIG. 10 shows a top view of the lower flange in FIG. 5.

As shown in FIG. 5, FIG. 9, and FIG. 10, the position-limiting protrusion 21 is a round protruding platform arranged coaxially with the lower flange 20. The second through hole 211 and the round protruding platform are eccentrically arranged, and an eccentricity e is fixed, and the cylinder 30 and the lower flange 20 are arranged coaxially. Specifically, the round protruding platform extends into the first through hole 411 of the connecting portion 41, to assemble the sliding block structure 40 and the lower flange 20 together. During the operation of the pump body assembly, the piston 50, during the movement, contacts and rubs with the two sliding sub-blocks 42 of the sliding block structure 40, so that the sliding block structure 40 is driven by the piston 50 to rotate relative to the round protruding platform. At the same time, the rotation shaft 60 passes through the second through hole 211, so that the rotation shaft 60 and the round protruding platform (the sliding block structure 40) are eccentrically arranged, thereby ensuring that an eccentricity of the pump body assembly is e, and achieving normal operation of the pump body assembly.

In these embodiments, through the foregoing structure arrangement, the eccentricity e of the pump body assembly is determined, so that a control manner of the eccentricity e is easier to ensure, simple and reliable.

As shown in FIG. 4 to FIG. 8, an inner cavity 32 of the cylinder 30 is in a shape of a circular hole, opposite surfaces of the two sliding sub-blocks 42 are surfaces on which the piston slides, and are parallel to each other, and surfaces of the two sliding sub-blocks 42, which face the inner cavity 32, fit the shape of the inner cavity 32.

Optionally, the sliding block structure 40 is symmetrical. In this case, during the operation of the pump body assembly, the foregoing arrangement enables the centrifugal forces of the two sliding sub-blocks 42 to counteract each other, thereby reducing the friction loss between the sliding block structure 40 and the inner wall of the cylinder 30, and prolonging the service life of the sliding block structure 40 and the cylinder 30.

In some embodiments, the sliding block structure 40 is manufactured and processed through cutting. In this case, the foregoing arrangement can ensure that the sliding block structure 40 is an integral structure, and that the friction loss between the two sliding sub-blocks 42 and the cylinder 30 caused by the centrifugal forces is reduced. At the same time, the foregoing processing manner makes the sliding block structure 40 simpler and easier to process, thereby reducing labor intensity of staff.

Specifically, the sliding block structure 40 is a cylinder structure with a certain roughness requirement and is hollowed out along a radial direction and an axial direction. A size and a shape of a hollow part along the radial direction are identical with the size and the shape of the piston 50, so that the remaining structure is two sliding sub-blocks 42. A hollow part along the axial direction is a circular hole coaxial with the outer circle of the sliding block structure 40.

Figure 4:
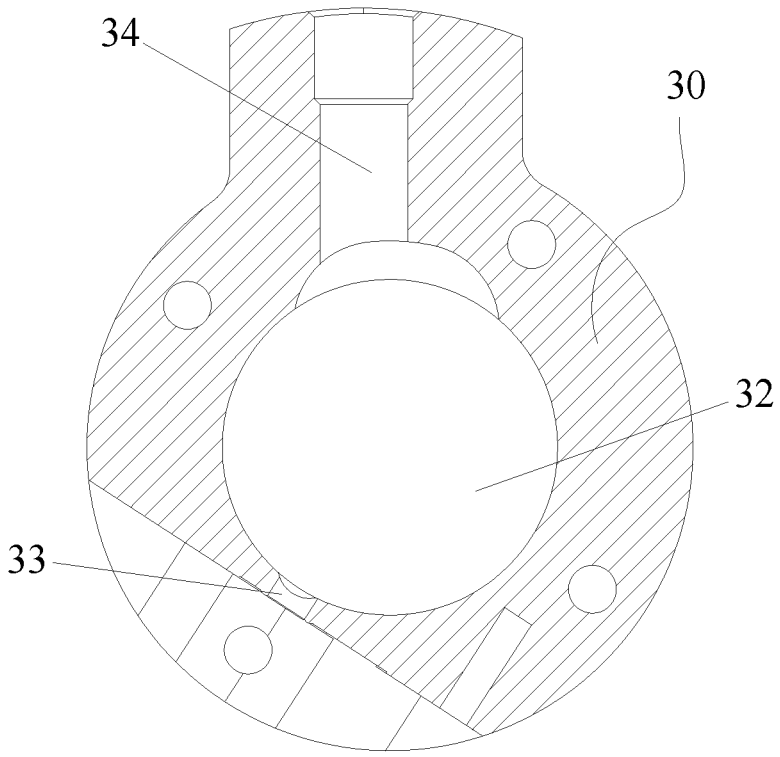
FIG. 4 shows a cross-sectional view of a cylinder of the pump body assembly in FIG. 3.

As shown in FIG. 3 and FIG. 4, an exhaust hole 33 is disposed in a side wall of the cylinder 30. The pump body assembly further includes an exhaust valve assembly 70. The exhaust valve assembly 70 is arranged on an outer surface of the cylinder 30 and is arranged corresponding to the exhaust hole 33.

As shown in FIG. 1, the rotation shaft 60 includes a cylindrical section 61 and a sliding section 62 connected sequentially along a length direction of the rotation shaft 60. The cylindrical section 61 is connected to an upper flange 10 by means of pivot. The sliding section 62 has two rotation shaft sliding surfaces arranged opposite to each other, and the two rotation shaft sliding surfaces slidably fit a groove wall of the second sliding hole 51. In this case, the sliding section 62 of the rotation shaft 60 passes through the upper flange 10 and then fits the second sliding hole 51.

Specifically, a motor of the pump body assembly drives the rotation shaft 60 to rotate along a central axis of the rotation shaft 60. The cylindrical section 61 rotates relative to the upper flange 10, and drives the sliding section 62 to rotate simultaneously, so that the two rotation shaft sliding surfaces of the sliding section 62 fit the groove wall of the second sliding hole 51, and that the piston 50 is driven by the rotation shaft 60 to perform a reciprocating slide along the second sliding direction.

In some embodiments, a lubrication groove is provided on each rotation shaft sliding surface. The lubrication groove is connected to a center hole of the rotation shaft 60 through an oil passage hole. An outer surface of the rotation shaft 60 is connected to an inner surface of the center hole through the oil passage hole. In this case, during the rotation of the rotation shaft 60, lubricating oil flows from the center hole into the lubrication groove through the oil passage hole, thereby ensuring that the lubricating oil can smoothly flow from the center hole into the lubrication groove, and lubricating the rotation shaft sliding surfaces. The foregoing arrangement guarantees the convenience of oiling from the center hole, and effectively avoids the friction loss caused by excessively large friction between the rotation shaft 60 and the piston 50, thereby improving movement smoothness of the rotation shaft 60 and the piston 50.

As shown in FIG. 2, the cylinder 30 has a suction passage 34 extending along a radial direction of the cylinder 30. The suction passage 34 is in communication with the first sliding hole 31. The foregoing arrangement can ensure that gas can enter the first sliding hole 31 and then enter the variable volume cavity, thereby ensuring normal operation of the pump body assembly.

In some embodiments, an outlet of the suction passage 34 is arc-shaped. The arc-shaped outlet can not only weaken the gas vortex phenomenon, but also reduce noise generated during intake, thereby improving user's use experience. The foregoing structure is simple and easy to process.

Specifically, by using one of the cavities as an example, the intake, compression, and exhausting process of the pump body assembly is described as follows: when the cavity is in communication with the suction passage 34, gas enters the variable volume cavity through the outlet, and suction starts; the rotation shaft 60 continues to drive the piston 50 and the sliding block structure 40 to rotate clockwise; when the cavity is separated from the suction passage 34, the whole suction ends; in this case, the cavity is completely sealed, and compression starts; the piston 50 continues to rotate, and the gas is constantly being compressed; when the cavity is in communication with the exhaust hole 33, the gas is exhausted through the exhaust hole 33; the piston 50 continues to rotate, and the gas is constantly being compressed and exhausted at the same time, till the cavity is completely separated from the exhaust hole 33, to complete the entire intake, compression, and exhausting process; and subsequently, after rotating for a certain angle, the cavity is connected to the suction passage 34 again, to enter a next cycle.

In the pump body assembly in these embodiments, the assembly process of the pump body assembly is specifically as follows:

The sliding block structure 40 is placed into the cylinder 30 first, and the first through hole 411 of the sliding block structure 40 fits the round protruding platform of the lower flange 20. A lower end of the rotation shaft 60 extends into the second sliding hole 51 of the piston 50, and the rotation shaft 60 fits the round protruding platform of the lower flange 20. Then, the piston 50 is installed inside a radial hole of the sliding block structure having a same shape as the piston 50. Then, the cylinder 30 is sleeved on an integral structure formed by the rotation shaft 60, the piston 50, the sliding block structure 40 and the exhaust valve assembly 70. Finally, the upper flange 10 and the lower flange 20 are connected to the cylinder 30 through fasteners to complete the assembly of the pump body assembly.

Figure 11:
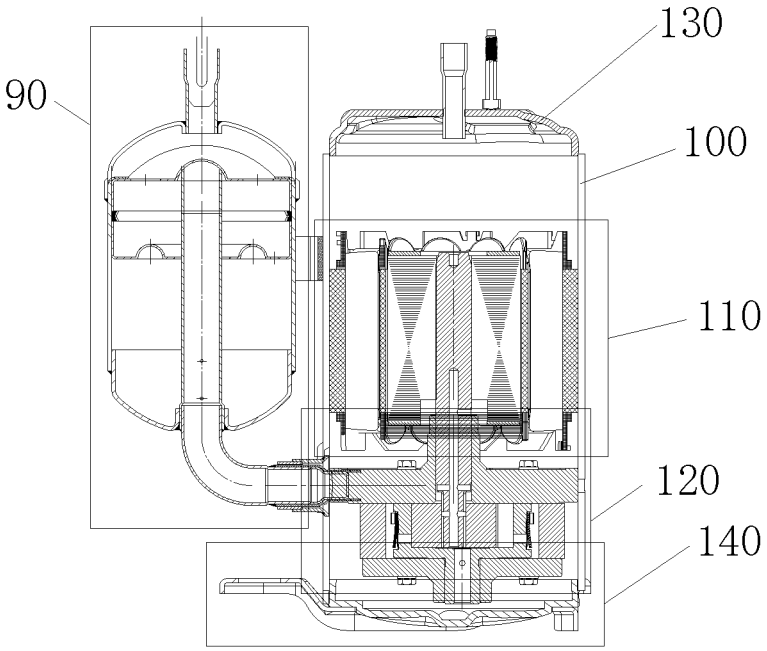
FIG. 11 shows a cross-sectional view of a compressor according to some embodiments of the present disclosure.

As shown in FIG. 11, the present application further provides fluid machinery, and the fluid machinery includes the foregoing pump body assembly. Optionally, the fluid machinery is a compressor. The compressor includes a liquid separator part 90, a housing assembly 100, a motor assembly 110, a pump body assembly 120, an upper cover assembly 130, and a lower cover and installing plate 140. The liquid separator part 90 is disposed outside the housing assembly 100. The upper cover assembly 130 is assembled on an upper end of the housing assembly 100. The lower cover and installing plate 140 is assembled on a lower end of the housing assembly 100. The motor assembly 110 and the pump body assembly 120 are both disposed inside the housing assembly 100, and the motor assembly 110 is disposed above the pump body assembly 120. The pump body assembly 120 of the compressor includes the upper flange 10, the lower flange 20, the cylinder 30, the sliding block structure 40, the piston 50, and the rotation shaft 60 that are described above.

Optionally, the foregoing parts are connected by means of welding, thermal sleeving, or cold pressing.

A heat exchange device (not shown) is further provided in this application and includes the foregoing fluid machinery. Optionally, the heat exchange device is an air conditioner.

In view of the above description, it can be seen that, the foregoing embodiments of the present disclosure achieve the following technical effects.

During the operation of the pump body assembly, at least a portion of the rotation shaft fits the second sliding hole of the piston and drives the piston to move, so that the piston performs a reciprocating motion along the first sliding direction relative to the rotation shaft. When the piston moves relative to the rotation shaft, the piston slides inside the first sliding hole simultaneously, and the sliding block structure is driven by the piston to move, so that the piston performs a reciprocating motion along the second sliding direction relative to the sliding block structure. The slide included angle is formed between the first sliding direction and the second sliding direction, and the piston performs a superposition motion of the first sliding direction and the second sliding direction, so the volume distribution of the variable volume cavity can be changed during the movement of the piston, thereby implementing intake, compression, and exhausting operations of the pump body assembly, and ensuring the normal operation of the pump body assembly.

In this case, the sliding block structure is an integral structure, and the two sliding sub-blocks are both arranged on the connecting portion. Compared with arrangement of two separated sliding blocks in the related technology, the foregoing structure arrangement of the sliding block structure in this application avoids the relatively high friction loss between the sliding block structure and the cylinder caused by the centrifugal forces, thereby reducing the friction loss of the cylinder, prolonging the service life of the pump body assembly, and improving the working efficiency of the pump body assembly.

Apparently, the embodiments described above are merely part of the embodiments of the present disclosure, rather than all the embodiments. Based on the embodiments of the present disclosure, all other embodiments obtained by those skilled in the art without creative efforts shall fall within the protection scope of the present disclosure.

It should be noted that terms used herein are only for the purpose of describing specific embodiments and not intended to limit the exemplary embodiments of the disclosure. The singular of a term used herein is intended to include the plural of the term unless the context otherwise specifies. In addition, it should also be appreciated that when terms "include" and/or "comprise" are used in the description, they indicate the presence of features, steps, operations, devices, components and/or their combination.

It should be noted that the terms "first", "second", and the like in the description, claims and drawings of the present disclosure are used to distinguish similar objects, and are not necessarily used to describe a specific order or time order. It should be appreciated that such terms can be interchangeable if appropriate, so that the embodiments of the disclosure described herein can be implemented, for example, in an order other than those illustrated or described herein.

The above descriptions are merely some embodiments of the present disclosure, and are not intended to limit the present disclosure. For those skilled in the art, various modifications and changes can be made for the present disclosure. Any modifications, equivalent substitutions, improvements, etc., made within the spirits and the principles of the present disclosure are included within the scope of the present disclosure.

What is claimed is:

1. A pump body assembly, comprising:

an upper flange;

a lower flange;

a cylinder, arranged between the upper flange and the lower flange;

a sliding block structure, rotatably arranged inside the cylinder, the sliding block structure comprising a connecting portion and two sliding sub-blocks arranged on the connecting portion, and the two sliding sub-blocks and an inner wall of the cylinder forming a first sliding hole;

a piston, slidably arranged inside the first sliding hole, a variable volume cavity being formed between the piston and an inner wall of the cylinder, and the piston having a second sliding hole; and a rotation shaft, wherein at least a portion of the rotation shaft is slidably arranged inside the second sliding hole, and a slide included angle is formed between a first sliding direction, in which the piston slides relative to the first sliding hole, and a second sliding direction, in which the rotation shaft slides relative to the second sliding hole;

wherein: the two sliding sub-blocks each comprise an inner side approximately perpendicular to the connecting portion, the inner side of each of the two sliding sub-blocks faces the piston and is a flat surface; an upper side of the sliding block structure opposite to the connecting portion is open, and upper ends of the two sliding sub-blocks opposite to the connecting portion are aligned with a top of the piston;

there is at least one connecting portion; the at least one connecting portion is provided with a first through hole; and the rotation shaft passes through the first through hole;

the first through hole is arranged on the at least one connecting portion; a position-limiting protrusion is arranged on the lower flange; the first through hole and position-limiting protrusion are nested and fit to connect the sliding block structure with the lower flange;

the position-limiting protrusion extends into the first through hole to enable the sliding block structure to pivot relative to the lower flange; the position-limiting protrusion has a second through hole; and the rotation shaft passes through the second through hole.

2. The pump body assembly according to claim 1, wherein the position-limiting protrusion is a round protruding platform arranged coaxially with the lower flange; the second through hole and the round protruding platform are eccentrically arranged, and an eccentricity e is fixed; and the cylinder and the lower flange are arranged coaxially.

3. The pump body assembly according to claim 1, wherein an inner cavity of the cylinder is in a shape of a circular hole; opposite flat surfaces of the two sliding sub-blocks are surfaces on which the piston slides, and are parallel to each other; and surfaces of the two sliding sub-blocks, which face the inner cavity, fit the shape of the inner cavity.

4. The pump body assembly according to claim 1, wherein the sliding block structure is manufactured and processed through cutting.

5. The pump body assembly according to claim 1, wherein an exhaust hole is disposed in a side wall of the cylinder; the pump body assembly further comprises an exhaust valve assembly; the exhaust valve assembly is arranged on an outer surface of the cylinder and arranged corresponding to the exhaust hole.

6. Fluid machinery, comprising the pump body assembly according to claim 1.

7. A heat exchange device, comprising the fluid machinery according to claim 6.

8. The pump body assembly according to claim 1, wherein the variable volume cavity comprises two cavities, and each cavity is formed by an arc surface of the piston and the inner wall of the cylinder.

9. The pump body assembly according to claim 1, wherein an eccentricity between a centerline $O_1$ of the sliding block structure and a centerline $O_2$ of the rotation shaft is the eccentricity e, and the sliding block structure and the rotation shaft rotate around their respective centerlines.

10. The pump body assembly according to claim 1, wherein the at least one connecting portion is one connecting portion, and the connecting portion is disposed at ends of the two sliding sub-blocks, which are proximate to the lower flange, to connect the two sliding sub-blocks together.

11. The pump body assembly according to claim 1, wherein the sliding block structure is symmetrical.

12. The pump body assembly according to claim 1, wherein a lubrication groove is provided on each rotation shaft sliding surface, and the lubrication groove is connected to a center hole of the rotation shaft through an oil passage hole.

13. The pump body assembly according to claim 1, wherein the cylinder has a suction passage extending along a radial direction of the cylinder, and an outlet of the suction passage is arc-shaped.

* * * * *